US005687910A

United States Patent [19]

King

[11] Patent Number: 5,687,910

[45] Date of Patent: Nov. 18, 1997

[54] SPRINKLER RISER CONNECTING APPARATUS

[75] Inventor: Robert King, Newhall, Calif.

[73] Assignee: King Bros. Industries, Valencia, Calif.

[21] Appl. No.: 594,353

[22] Filed: Jan. 30, 1996

[51] Int. Cl.[6] ..... B05B 15/06

[52] U.S. Cl. ..... 239/276; 248/87; 403/391; 403/389; 403/398

[58] Field of Search ..... 239/273, 276, 239/285; 248/75, 80, 87, 88, 156, 125.1, 74.1, 74.2, 49; 403/391, 389, 398, 384

[56] References Cited

U.S. PATENT DOCUMENTS 2,852,300 9/1958 Clark ..... 239/276

3,105,510 10/1963 Demosthenes ..... 239/276 X 3,941,342 3/1976 Bradshaw ..... 239/276 X 5,435,490 7/1995 Machut ..... 239/276

*Primary Examiner*—Lesley D. Morris

*Attorney, Agent, or Firm*—Oppenheimer Poms Smith

[57] ABSTRACT

Sprinkler riser connecting apparatus including a connector having a first generally cylindrical hollow sleeve adapted to be mounted in a fixed secure relationship to a vertically extending stake extending upwardly from the ground. A split sleeve is connected to the hollow sleeve having a through-bore adapted to receive a vertically extending sprinkler riser pipe therein. The sleeve is comprised of two semi-circular pieces which can be spread apart over the riser, then snapped together to secure the riser therebetween.

15 Claims, 3 Drawing Sheets

FIG. 2
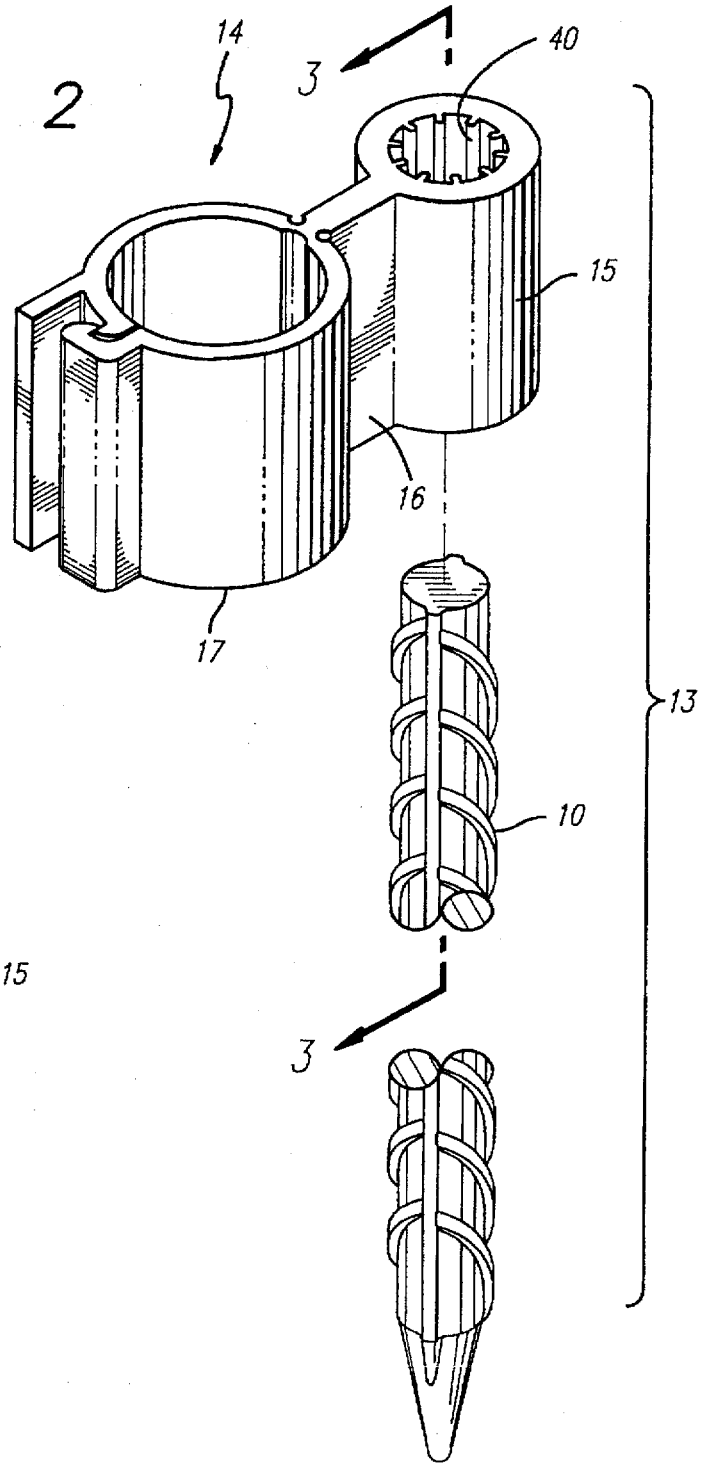
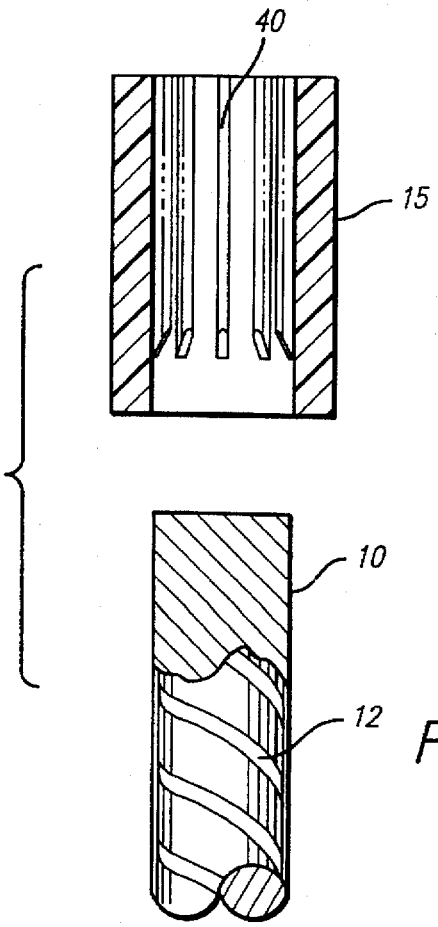
FIG. 3

SPRINKLER RISER CONNECTING APPARATUS

BACKGROUND OF THE INVENTION

1. Field of the Invention

The invention relates to sprinkler systems; and, more particularly, to sprinkler riser connecting apparatus.

2. Description of the Prior Art

At present, steel bars or rods referred to as rebars are used in irrigation systems to which sprinkler risers are attached to hold them in operative position. This is accomplished by means of stainless steel clamps encircling the rebars and the risers. Alternatively, stainless steel wire, duct tape, electrical tape or electrical wire, or the like may be used. Obviously, the application of such clamps, tape or wire is time consuming and none hold the riser pipe firmly and plumb to the steel rebar stake.

SUMMARY OF THE INVENTION

It is an object of this invention to provide sprinkler riser connecting apparatus which can hold a sprinkler riser to a stake in a firm and plumb relationship.

It is still further an object of this invention to provide such apparatus which is inexpensive, easy to use and can be easily mounted to a support stake, then snap fit to a riser.

It is still further an object of this invention to provide such a snap on device that holds the riser upright on hillsides and the like and keeps the riser from turning on the support stake.

These and other objects are preferably accomplished by providing sprinkler riser connecting apparatus including a connector having a first generally cylindrical hollow sleeve adapted to be mounted in a fixed secure relationship to a vertically extending stake extending upwardly from the ground. A split sleeve is connected to the hollow sleeve having a throughbore adapted to receive a vertically extending sprinkler riser pipe therein. The sleeve is comprised of two semicircular pieces which can be spread apart over the riser, then snapped together to secure the riser therebetween.

BRIEF DESCRIPTION OF THE DRAWING

FIG. 2 is an exploded view of the connector alone of the apparatus of FIG. 1 illustrating connection to a stake;

FIG. 3 is a view taken along lines 3—3 of FIG. 2;

DESCRIPTION OF THE PREFERRED EMBODIMENT

Figure 1:
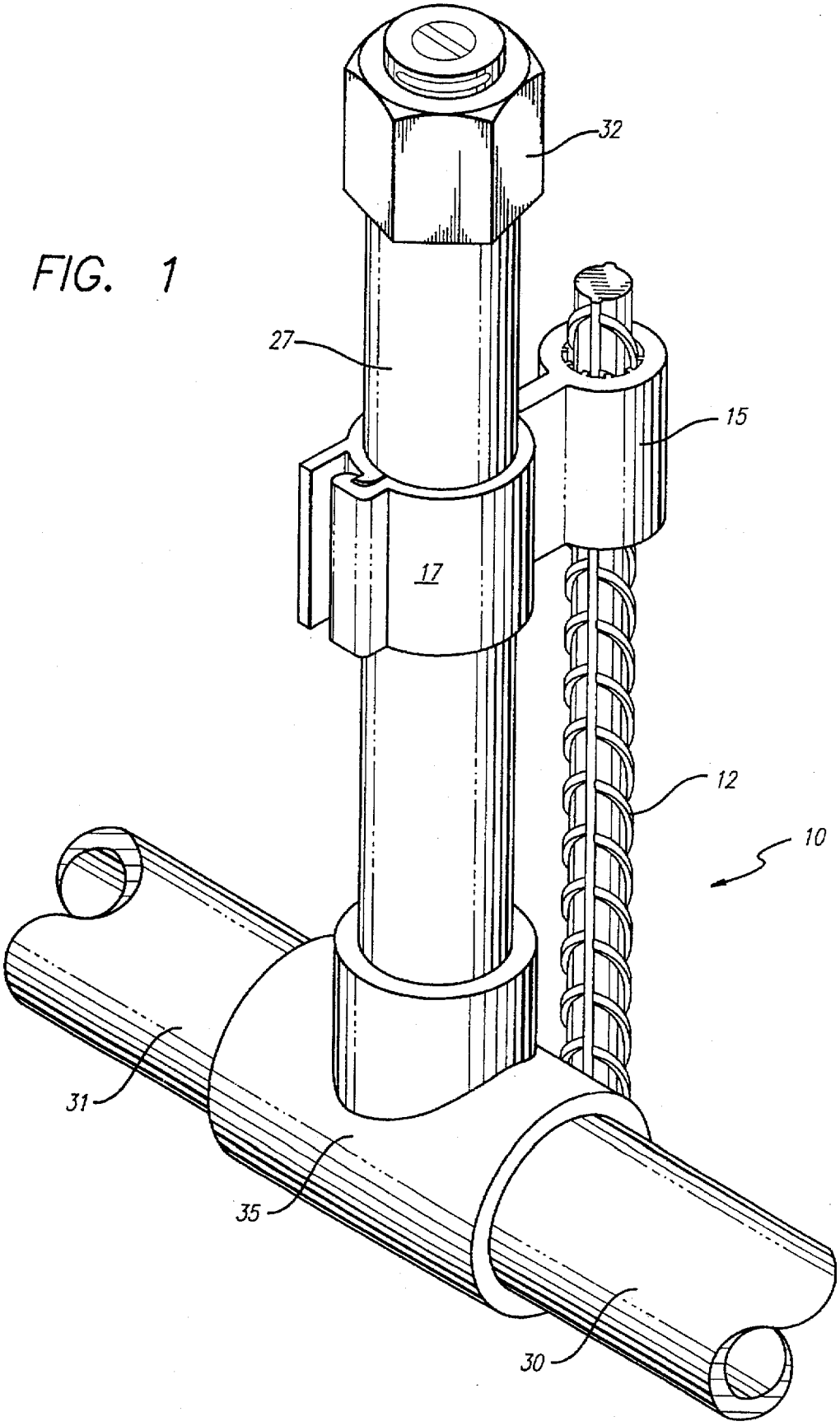
FIG. 1 is a perspective view of the sprinkler riser connecting apparatus in accordance with the teachings of the invention.

Referring now to FIG. 1 of the drawing, a stake 10 is shown adapted to extend upwardly from a surface, such as a lawn or the like. As seen in cross-section in FIG. 2, stake 10 has a plurality of longitudinally extending spiral ribs 12 on the outer surface thereof. Stake 10 may be made of any suitable material but is usually a steel bar or rod hammered or otherwise mounted into the surface supporting and referred to as rebar in the trade.

As particularly contemplated in the present invention, sprinkler riser connecting apparatus 13 is shown comprising a connector 14 and the aforementioned stake 10. Connector 14 includes a cylindrical sleeve 15 connected by an integral extension portion 16 to a split sleeve 17.

Figure 4:
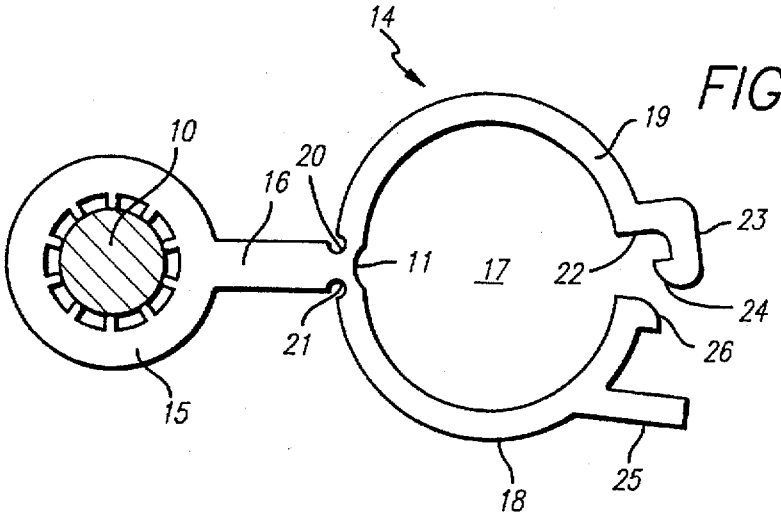
FIG. 4 is a view, partly in sectional, illustrating the connector of FIG. 2 secured to the stake, in a first position.

Sleeve 17 is comprised of two semi-circular sections 18, 19 (see also FIG. 4). Section 19 is interconnected to portion 16 and section 18 by a reduced web 20 and section 18 is interconnected to portion 16 and section 19 by a reduced web 21. The inner walls of sections 18, 19 are also interconnected by a reduced portion 11. Section 19 terminates at its free end in a first elongated portion 22 extending outwardly from section 19, then having an integral portion 23 extending generally normal to portion 22. Portion 23 extends inwardly toward the center of sleeve 17, generally parallel to and spaced from portion 22, forming a hook 24. As seen in FIG. 2, hook 24 is curved on its exterior to facilitate coupling the same to section 18.

Section 18 has a first integral extension portion 25 extending outwardly away from section 18 spaced from the free end thereof. The free end of section 18 terminates in an outwardly extending hook 26, spaced from extension portion 25, and also curved on its exterior to facilitate coupling.

Connector 14 may be made of any suitable materials enabling the teachings of the intention to be carried out. Preferably, plastic, which can deform and flex at webs 20, 21, is preferred.

In operation, sleeve 15 is hammered down (FIGS. 2 and 3) on the top of stake 10, the ribs 40 on the interior or inner wall of sleeve 15 thereby deforming when engaging ribs 12 on stake 10. This makes the riser support 15 fit tightly and snugly to stake 10. Sleeve 17 is in the open FIG. 4 position.

FIG. 4 thus illustrates a typical installation where connector 14 has been coupled to stake 10. The semi-circular sections 18, 19 are in the non-connected position.

Figure 5:
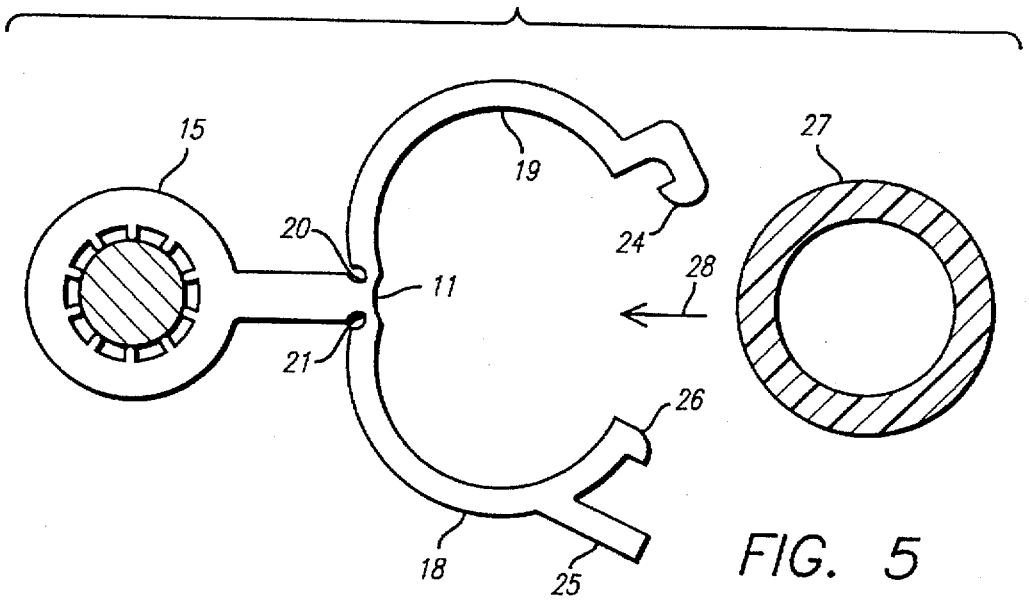
FIG. 5 is a view similar to FIG. 4 showing the connector of FIG. 4 in a second position adapted to be connected to a riser.

The sections 18, 19 are now spread apart (FIG. 5) flexing at webs 20, 21, and 11 to accept the hollow sprinkler riser pipe 27 (see also FIG. 1) which is inserted between sections 18, 19 in the direction of arrow 28. As seen in FIG. 1, pipe 27 may be coupled to a three way connector 35 having supply lines 30, 31 coupled thereto and may have a sprinkler head 32 secured to the top thereof.

Figure 6:
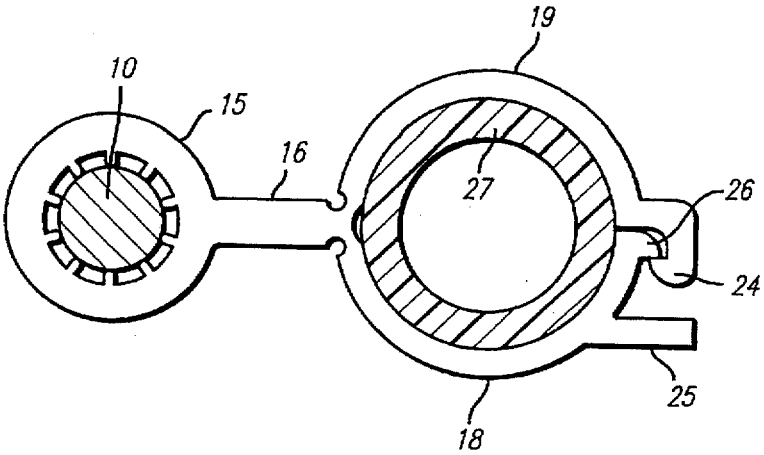
FIG. 6 is a view similar to FIG. 5 showing the final assembled position.

As seen in FIG. 6, sections 18, 19 are then snapped together about pipe 27, hook 24 riding over the outer configuration of hook 26 and snapping into position as seen in FIG. 6. Extension portion 25 facilitates connection by enabling the operator to push thereagainst forcing the sections 18, 19 together. The final installed position is also shown in FIG. 1.

It can be seen that the foregoing arrangement eliminates the need for wire, tape, etc. to hold the riser pipe to the support. Such a system not only saves installation time but holds the pipe firmly and plumb to the stack. If plastic is used, such a material is resistant to sunlight and weathering. The cylindrical section or sleeve 15 is placed on top of the stake 10 and used to drive it into the ground. The end of the connector with the two semi-circular pieces is then spread over the riser pipe and the pieces are snapped together. The installation is neat, simple and quick.

The apparatus herein is especially useful in hillside irrigation systems, where the pipe is often laid on the surface of a slope. These snap-on riser supports hold the risers upright on the hillsides and keep the riser from turning on the pipe.

Although a particular embodiment of the invention has been disclosed, variations thereof may occur to an artisan and the scope of the invention should only be limited by the scope of the appended claims.

I claim:

1. Apparatus for maintaining a sprinkler riser pipe in a firm upright position in a sprinkler system comprising:

a stake adapted to be mounted in a generally vertically position in a sprinkler system supporting surface;

a connector including a generally hollow sleeve having a throughbore with a cross-section generally conforming to the cross-section of said stake and slightly greater in diameter thereof whereby said sleeve may be mounted on said stake encircling the same in a close-fitting relationship; and a pair of generally semi-circular sections coupled to said sleeve by an extension portion, each of said sections having flexible portions interconnecting said sections to said extension portion, each of said section having mating interlocking means at the free ends thereof whereby said sections may be moved from a first open position wherein said free ends are spaced from each other to a second closed position surrounding a sprinkler riser pipe in a tight close fitting relationship with said free ends interlocked in a snap fitting relationship.

2. In the apparatus of claim 1 including said sleeve throughbore having a plurality of axially extending ribs thereon.

3. In the apparatus of claim 1 including a sprinkler riser pipe secured between said interlocking sections when said sections are in the second position.

4. In the apparatus of claim 1 wherein said sleeve, said extension portion and said sections are of one integral piece.

5. In the apparatus of claim 4 wherein said integral piece is of plastic.

6. In the apparatus of claim 1 wherein said stake has a plurality of spiral ridges on the outer surface thereof.

7. A connector for coupling a sprinkler riser pipe to a riser support comprising:

a generally hollow sleeve having a throughbore;

a pair of generally semi-circular sections coupled to said sleeve by an extension portion, each of said sections having flexible portions interconnecting said sections to said extension portion, each of said section having mating interlocking means at the free ends thereof whereby said sections may be moved from a first open position wherein said free ends are spaced from each other to a second closed interlocking position.

8. In the connector of claim 7 including said sleeve throughbore having a plurality of axially extending ribs thereon.

9. In the connector of claim 8 wherein said sleeve, said extension portion and said sections are of one integral piece.

10. In the connector of claim 9 wherein said integral piece is of plastic.

11. In the connector of claim 7 wherein said connector is of plastic and said flexible portions are webbed portions of a material thinner than the thickness of said sleeve and said sections.

12. In the connector of claim 7 wherein said sleeve is cylindrical.

13. In the connector of claim 7 wherein the free end of one of said sections includes a first extending portion extending outwardly from said one of said sections, a second extending portion integral with said first extending portion extending generally normal thereto, and a hook portion integral with said second extending portion extending inwardly toward said one of said sections, and the other of said sections having a free end terminating in a hook, said hooks interlocking to form said interlocking means.

14. In the connector of claim 13 wherein each of said hooks are curved on their outer surfaces.

15. In the connector of claim 13 including an elongated extension portion extending outwardly from said one of said sections spaced from the hook of the free end thereof.

* * * * *